United States Patent [19]

Bastien

[11] Patent Number: 5,042,514

[45] Date of Patent: Aug. 27, 1991

[54] HAIRDRESSING SYSTEM

[76] Inventor: Ernest J. Bastien, 362 DeAnza Dr., Vallejo, Calif. 94589

[21] Appl. No.: 461,430

[22] Filed: Jan. 5, 1990

[51] Int. Cl.[5] ..... A45D 19/18

[52] U.S. Cl. ..... 132/270; 132/208; 132/252

[58] Field of Search ..... 132/208, 222, 212, 246, 132/248, 249, 250, 251, 252, 253, 254, 260, 270, 902

[56] References Cited

U.S. PATENT DOCUMENTS

| | | | |
|---|---|---|---|
| 429,984 | 6/1890 | Wegefarth | 132/252 |
| 1,599,988 | 9/1926 | Cotton | 132/250 |
| 1,972,981 | 9/1934 | De Requesens | 132/212 |
| 2,254,816 | 9/1941 | Bergmann | 132/251 |
| 2,611,376 | 9/1952 | McIntyre | 132/252 |
| 3,101,724 | 8/1963 | Nizetich | 132/270 |
| 3,452,759 | 7/1969 | Sarinelli | 132/270 |
| 3,590,829 | 7/1971 | Parisi | 132/248 |
| 3,682,182 | 8/1972 | Small | 132/252 |
| 3,800,811 | 4/1974 | Esposto | 132/270 |
| 3,943,946 | 3/1976 | Gallegos | 132/251 |
| 3,968,805 | 7/1976 | Sobek, Jr. | 132/270 |
| 4,144,897 | 3/1979 | Mosz | 132/270 |
| 4,201,236 | 5/1980 | Morefield | 132/250 |
| 4,209,027 | 6/1980 | Morganroth | 132/212 |
| 4,211,247 | 7/1980 | Morganroth | 132/270 |
| 4,224,954 | 9/1980 | Stahl | 132/208 |
| 4,273,144 | 6/1981 | Morganroth | 132/270 |
| 4,465,084 | 8/1984 | Fulgoni | 132/252 |
| 4,503,870 | 3/1985 | Peterson | 132/270 |
| 4,665,933 | 5/1987 | Zinger et al. | 132/270 |
| 4,911,186 | 3/1990 | Hayden | 132/246 |

FOREIGN PATENT DOCUMENTS

| | | | |
|---|---|---|---|
| 3244174 | 5/1984 | Fed. Rep. of Germany | 132/208 |

*Primary Examiner*—John J. Wilson
*Assistant Examiner*—Frank A. LaViola
*Attorney, Agent, or Firm*—Harris Zimmerman

[57] ABSTRACT

Application of bleach, dye or the like to selected strands of hair is facilitated by drawing each strand into one of a series of tubes, applying clamps to selected locations along each tube to close the ends or to isolate adjoining portions of the interior of the tube from each other and injecting hair treating solution into tubes which solution need not necessarily be of the same type or color at successive portions of the same tube. The tubes are formed of flexible resilient material and have sidewalls with overlapping abutted edges that define a slit that extends along the tube. The slits are normally sealed by the resiliency of the material but can be pried open by a hair manipulating tool to draw a strand of hair into the tube and can also be opened by the spout of squeeze bottle to administer the hair treating solution. Channel shaped caps formed of resilient material can be snapped onto the tubes over the slits to assure retention of fluid.

15 Claims, 2 Drawing Sheets

FIG_1
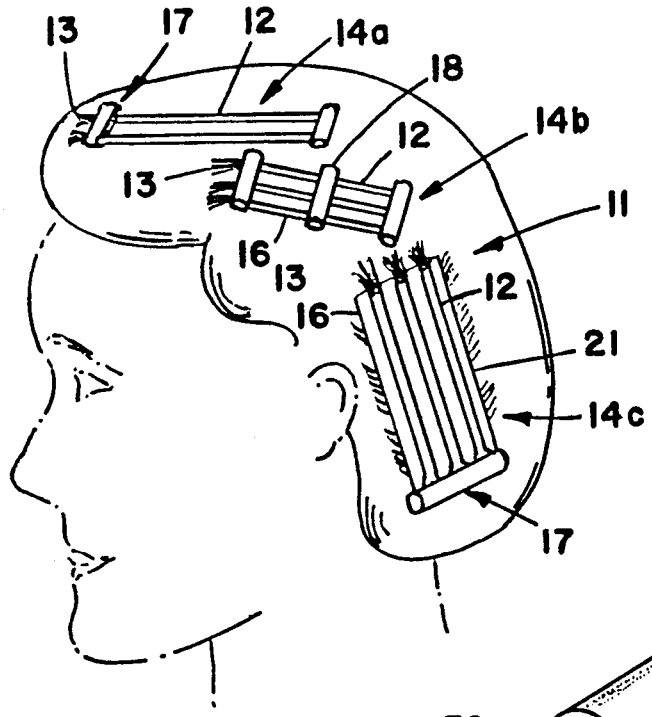
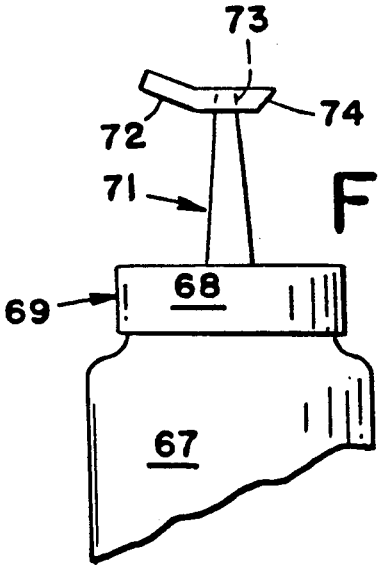
FIG_11
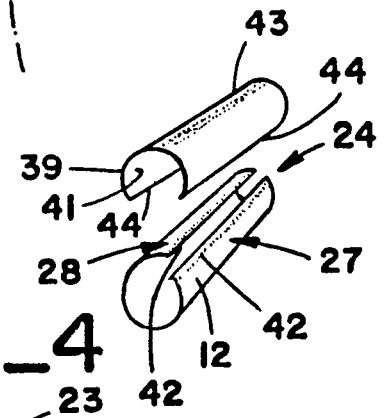
FIG_4
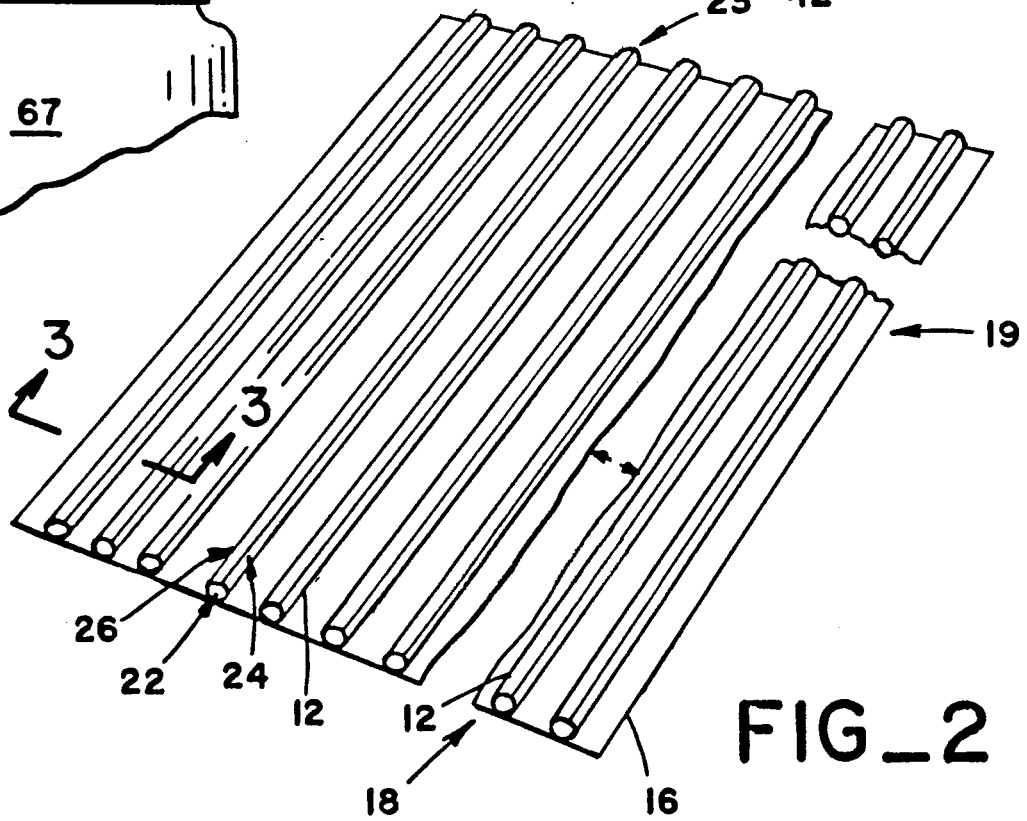
FIG_2

HAIRDRESSING SYSTEM

TECHNICAL FIELD

This invention relates to hairdressing apparatus and more particularly to devices for facilitating the application of bleaches, dyes, tinting solutions or the like to selected strands of a person's hair.

BACKGROUND OF THE INVENTION

Certain hairdressing procedures, such as frosting or streaking for example, require the application of dyes, bleaches, tinting solutions or the like to selected strands of hair. The substance which is applied to the hair must usually remain in place for a period of time after which it is removed by washing the strand of hair.

In most cases, it is desirable to confine the hair treatment solution to one or more specific strands and to prevent contact of the solution with adjoining areas of the persons hair. Prior devices for accomplishing this are not entirely satisfactory.

One common procedure involves wrapping metal foil around each strand of hair that is to be treated, securing the foil in place with rubber bands or the like and injecting the hair treating solution into the wrapped foil with the pointed tip of a squeeze bottle. The foil does not form a desirably fluid tight enclosure and leakage of the hair treatment solution into adjoining areas of hair can easily occur. Unwrapping and removal of the foil can also be somewhat taxing if inadvertent transfer of the solution to other areas of hair is to be avoided.

In another common procedure, a cap having spaced apart apertures is fitted onto the person's head and strands of hair are pulled through the apertures. Treating solution may then be applied to the strands while the cap protects other areas of the person's hair. This procedure can be somewhat painful. Drawing the strands out through the apertures and the later removal of the cap while the strands protrude through the apertures both are both accompanied by a pulling on the roots of the hair.

A variety of other devices have been developed for the purpose of confining hair treatment solutions to individual strands of hair but each is subject to one or more limitations. Some are too costly to be treated as disposable items and must be washed and stored between uses. Others do not enable easy inspection of hair during the treatment process. The prior devices do not accommodate easily to adding more hairs, or removing some of the hairs, while the treatment is in progress.

Prior devices do not provide a practical way to stop the treatment of one strand of hair, by washing, while the treatment of other strands is continued. The prior devices also do not provide a practical, convenient way of coloring successive portions of a single strand of hair in different colors during a single treatment. These capabilities would greatly increase the range of effects that can be created by the cosmetologist.

The present invention is directed to overcoming one or more of the problems discussed above.

SUMMARY OF THE INVENTION

In one aspect, the present invention provides hairdressing apparatus for facilitating the application of dyes, bleach or the like to selected strands of hair and includes at least one hollow tube having an interior region in which the strand of hair and the dye, bleach or the like may be disposed. A slit extends along the sidewall of the tube and is defined by first and second edge regions of the sidewall that abut each other to inhibit escape of substances from the interior of the tube. The tube is formed of flexible, resilient material and thus the first and second edges may be temporarily pulled apart at a selected location along the slit to provide access to the ininterior region of the tube at that location.

In another aspect, the invention further includes a channel shaped cap member having an internal surface conforming to the external surface of the tube. The cap member is formed of flexible, resilient material and is proportioned for fitting onto the tube over the slit which extends along the tube.

In another aspect, the invention further includes clamping means for compressing the tube at selected locations along the tube to isolate one portion of the interior of the tube from an adjoining portion.

In another aspect of the invention, the apparatus includes a hair manipulating tool having a handle and having first and second hooks at the lower end of the handle. The first hook has an upwardly directed pointed tip and the second hook has a downwardly directed pointed tip, the hooks being proportioned for insertion into the interior region of the tube through the slit which extends along the tube.

In a further aspect of the invention, the apparatus includes a cap for a hair treating solution bottle. The cap has a base adapted for engagement on the bottle and has a tubular solution dispensing tip extending outward from the base, the tip having a distal end proportioned for insertion into the tube through the slit which extends along the tube. A hook extends laterally from the distal end of the tube and is proportioned for entry into the tube along with the distal end of the tip.

In still another aspect of the invention, the hairdressing apparatus for facilitating application of dyes, bleaches or the like to selected strands of hair includes a flat backing plate, a plurality of tubes secured to the plate and which are parallel to the plate and parallel to each other, the tubes being spaced apart a distance sufficient to enable flattening of selected ones of the tubes at selected locations along the tube without interference from an adjacent tube. A slit extends along the sidewall of each of the tubes at the side of the tube that is opposite from the backing plate. The slit is defined by first and second overlapping edge regions of the tube sidewall that abut each other. The tubes are formed of flexible, resilient material enabling temporary opening of the slits at selected locations along the tubes.

The invention provides slitted tubes into which selected strands of hair may drawn and which are self-sealing to retain any of a variety of hair treatment solutions around the strands. Clamps provide for isolation of selected portions of each tube from adjoining portions thereby enabling different portions of the same strand of hair to be treated in a different manner at the same time. Successive portions of the same strand may be given different colors or a polka dot effect may be created, for example. The self-sealing slits along the tubes enable access to the strands at any point along the tube during the treatment period in order to inspect the condition of the hair or to withdraw or add hairs. The construction also enables stopping of the treatment of different strands at different times by running water through an individual tube to rinse away the treatment solution from an individual strand. In the preferred form of the invention, the tubes are formed of low cost, transparent plastic and can be treated as disposable items. The invention further provides tools for drawing strands of hair into the slitted tubes and a tool which can be used to admit treatment solution into the tube at the same time that the strand is being drawn into the tube.

The invention, together with further advantages thereof, may be further understood by reference to the following description of a preferred embodiment and by reference to the accompanying drawings.

BRIEF DESCRIPTION OF THE DRAWINGS

FIG. 1 depicts elements of the invention as they may appear during a hairdressing procedure in which selected strands of a person's hair are to be given desired colorations.

FIG. 2 is a perspective view of a block of hair treatment tubes in accordance with a preferred embodiment of the invention.

FIG. 4 is a perspective view of a portion of an individual tube and a cap member for the tube.

FIG. 11 is a side view of a hair treatment bottle cap having adaptations for facilitating use of the hair treatment tubes.

DETAILED DESCRIPTION OF THE PREFERRED EMBODIMENT

Figure 3:
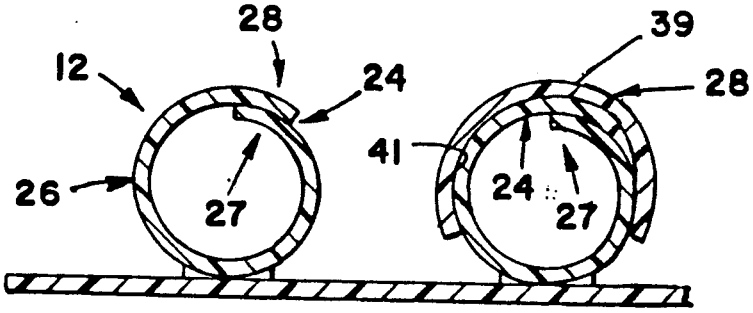
FIG. 3 is a cross section view of a portion of the structure of FIG. 2 taken along line 3—3 thereof.

Referring initially to FIG. 1 of the drawings, a hairdressing system 11 in accordance with this embodiment of the invention includes a series of hair treatment tubes 12 in which selected individual strands 13 of hair are disposed during procedures which call for application of dye, bleach, tinting solution or the like to selected areas of hair. The tubes may be used singly as at tube assembly 14*a*, in pairs which are joined together by a backing plate 16 as in the case of tube assembly 14*b* or in larger groupings also joined together by a backing plate as in the case of tube assembly 14*c*.

Clamping means 17, to be hereinafter described in more detail, are provided for compressing and flattening the ends of the tubes 12 to prevent escape of hair treatment solution through the ends of the tubes. The clamping means 17 may also be used a locations away from the ends of the tubes to isolate one portion of the tube from another as in the case of the intermediate clamp 18 used on tube assembly 14*b* in the present example. This enables different portions of the same strand 13 of hair to be given different treatments and colorations and also enables coloring of portions of a given strand while intervening portions are left untreated.

Referring to FIG. 2, it is advantageous if a sizable number of the tubes 12 are secured to a sizable thin backing plate 16 in parallel relationship to the plate and to each other. Flattening of an individual tube 12 by a clamp as hereinbefore described results in some lateral spreading of the compressed portion of the tube and thus the tubes should be spaced apart on plate 16 a distance sufficient to accommodate to this spreading including in instances where two adjacent tubes are to be flattened at corresponding locations along the two tubes.

Handling and storage of the tubes 12 prior to use is facilitated if there is a larger number of tubes on one backing plate 16 than will typically be used as a unit. The backing plate 16 is formed of thin plastic which can easily be cut with scissors or the like. Thus, as depicted in FIG. 2, the desired number of tubes 12 can be detached from the rest by cutting backing plate 16 along a line 18 situated midway between two tubes. The length of the detached tubes 12 and the detached portion of the backing plate 16 can be shortened as might be desirable for treating short strands of hair by cutting along a transverse line 19.

The backing plate 16 prevents entanglement of adjacent tubes 12 and rotation of the tubes about their own axes which movements could complicate the operations to be hereinafter described. Referring again to FIG. 1, the backing plate 16 can also be used to hold the tubes 12 at a fixed location on a persons scalp during treatment as the edges of the plate can be buried in adjacent hair 21 to inhibit movement of the tube assembly 14*c*.

Referring jointly to FIGS. 2 and 3, the opposite ends 22 and 23 of each tube 12 are open and each tube has a longitudinal slit 24 which extends from end to end along the portion of the tube sidewall 26 that is opposite from backing plate 16 and the adhesive 25 which secures the tube to plate 16. In the preferred form, the slit 24 is defined by edge regions 27 and 28 of tube sidewall 26 that overlap in the region of the slit. Each tube 12 is formed of flexible, resilient fluid-tight material such as any of the known resilient plastics. The resiliency of the material causes the edge regions 27 and 28 to exert pressure against each other and thus the edge regions act as a fluid seal at slit 24.

The seal provided by the resiliency of the tube 12 material is adequate for many purposes, particularly if the hair treatment solution that is to be contained in the tube is somewhat viscous. In other instances it may be desirable to provide additional assurance against leakage. Referring jointly to FIGS. 3 and 4, this is provided for by a cap member 39 which can be snapped onto the tube 12 to cover the slit 24 and to exert additional pressure against tube sidewall edge regions 27 and 28. (FIG. 4 in particular depicts the tube 12 in an opened up, distended condition in order to better illustrate certain features of the tube.)

Cap member 39 is a channel shaped element formed of resilient material that may be the same as the material of which the tube 12 is formed and has an inner surface 41 with a configuration conforming to that of the portion of the outer surface of tube 12 that is contacted by the cap member. Cap member 39 is proportioned to extend around more than 180 degrees of the circumference of tube 12 so that it clasps the tube when in place. Cap members 39 may be cut to have lengths corresponding to those of the tubes 12 when the tubes themselves are cut in the manner previously described.

Referring to FIG. 4 in particular, the tubes 12 and cap members 39 are preferably formed of transparent material to enable inspection of the hair and solution within the tubes without necessarily opening the tubes. It is advantageous if the edge regions 27 and 28 that define the slit 24 in the tube 12 are colored, such as by red stripes 42 in this example, so that the location of the slit can be easily ascertained by visual inspection. It is also advantageous if the centerlines of the cap members 39 are marked with a different coloration as the operator can then visually verify that each cap member is fully engaged on its tube 12 in a centered relationship over the tube slit 24. In this example, a blue stripe 43 extends along the cap member 39 at a location which is equidistant from the long edges 44 of the member.

Figure 5:
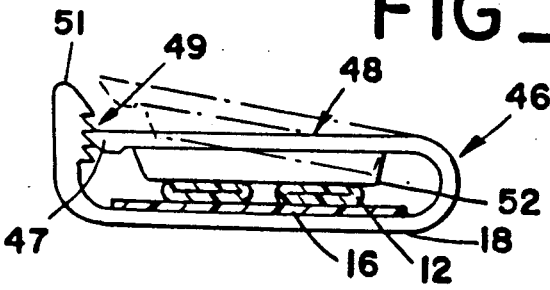
FIG. 5 is a side view of a clamp used to isolate portions of the tubes from each other.
Figure 6:
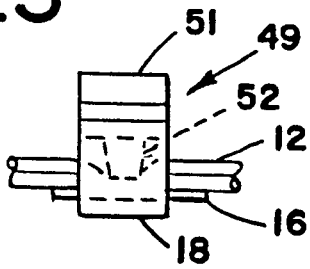
FIG. 6 is an end view of the clamp of FIG. 5.

Referring to FIGS. 5 and 6 in conjunction, the clips or clamps 18 that are used to seal the ends of tubes 12 or to seal one portion of the tube from another portion may be of any of a variety of forms. In this example, the clamp is a somewhat flattened out band 46 formed of flexible resilient material which can be opened at one location to receive one or more tubes 12 and the backing plate 16 portion to which those tubes are secured. The opening in band 46 is defined by a knife-like edge 47 at one end of the upper part 48 of the band which engages in a selected one of a series of transverse serrations 49 on the inside of an adjacent upwardly directed portion 51 of the band in order to hold the clamp 18 in the closed condition. A lug 52 extends down from the underside of the upper part 48 in position to compress and flatten the tubes 13 when the clamp is closed.

The particular clamp 18 shown in FIGS. 5 and 6 has a length sufficient to span two of the tubes 12 and can also be used with a single tube. Additional clamps of similar construction but greater length are used where a larger number of tubes 12 are to be sealed at the same locations along the tubes.

Figure 7:
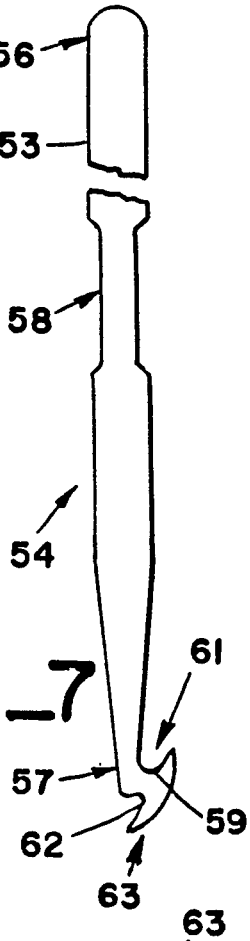
FIG. 7 is a side view of a hair manipulating tool for use with the apparatus of the preceding figures.
Figure 8:
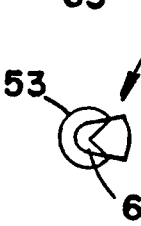
FIG. 8 is a bottom end view of the hair manipulating tool of FIG. 7.
Figure 9:
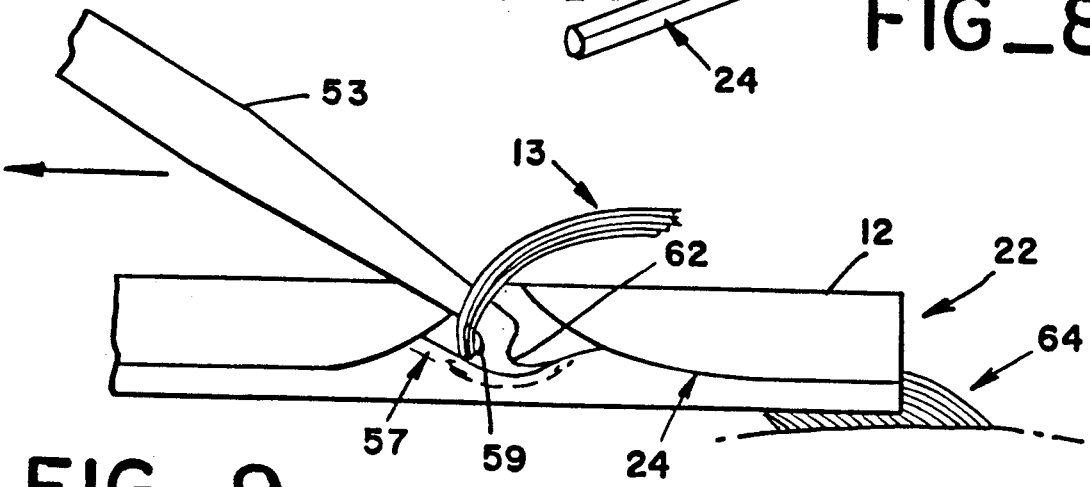
FIG. 9 illustrates use of the tool of FIGS. 7 and 8 to draw a strand of hair into one of the tubes of FIGS. 1 to 3.

FIGS. 7 and 8 depict a hair manipulating tool 53 which facilitates use of the previously described components of the system. Tool 53 has a straight handle 54 with upper and lower ends 56 and 57 respectively and may have a flattened region 58 somewhat above the lower end to facilitate grasping of the tool with the thumb and forefinger. A first hook 59 at lower end 57 has a pointed tip 61 directed upwardly and a slightly lower second hook 62 with a pointed tip 63 that is directed downwardly. Referring to FIG. 9, the first and second hooks 59 and 62 are sufficiently small to enable entry of both hooks into the slits 24 of tubes 12.

The tool 53 may be used for several purposes. Drawing of a strand 13 of hair into a tube 12 is accomplished by hooking the root region 64 of the strand with first hook 59. The lower end 57 of the tool including both hooks 59 and 62 and the hair engaged thereon is then forced into one of the open ends 22 of a tube 12. The lower end 57 of the tool is then traveled along the tube 12 to draw successive portions of the strand 13 into the tube through slit 24 which temporarily opens at successive locations along the tube in response to the tool movement and then recloses behind the tool.

Figure 10:
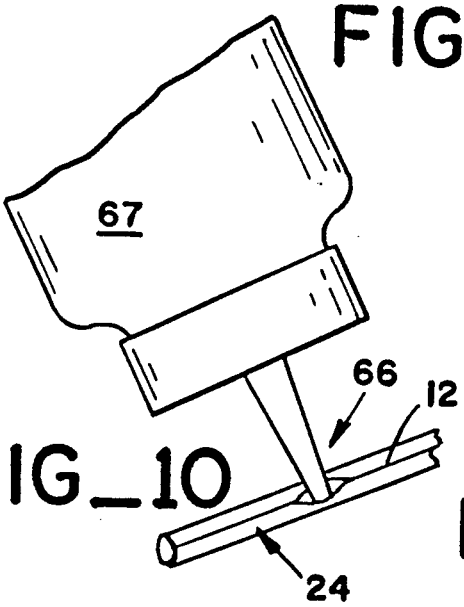
FIG. 10 illustrates procedure for admitting hair treatment solution into one of the tubes at a selected location therealong.

Referring again to FIG. 1, after selected strands 13 of hair have be encased in the tubes 12, clamps 18 are used to seal the ends of the tubes in the previously described manner and to seal portions of tubes off from adjoining portions if different regions of a strand of hair are to receive different treatments. Referring to FIG. 10, the desired hair treating solution or solutions is then admitted into each tube 12 through the openable slit 24. This may be accomplished by prying the slit 24 open with the pointed tip 66 of a convenional squeeze bottle 67 and then compressing the bottle to eject solution into the tube.

Referring again to FIG. 9, the second or downwardly directed hook 62 of tool 53 may be used to open the slit 24 to inspect the progress of a hair treatment or for the purpose of adding more hairs or withdrawing hair through the slit. The second hook 62 may also be used to pick the strand 13 out of the tube 12 through slit 24 at the conclusion of the hair treatment.

Referring to FIG. 1, treatment of a hair strand 13 in any tube 12 may be stopped without necessarily stopping the treatment of hair in other tubes by removing the clamps 18 from the particular tube and using a syringe to flow water through the tube.

Figure 12:
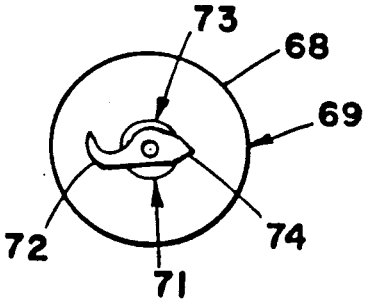
FIG. 12 is a top view of the bottle cap of FIG. 11.

In the above described operation of the invention a tool 53, shown in FIG. 9, is used to draw hair into the tube 12 and for certain other purposes and a squeeze bottle, shown in FIG. 10, is used to add hair treating solution. Referring to FIGS. 11 and 12, a specialized cap 68 for a squeeze bottle 67 enables these operations to be effected simultaneously with the same implement. Cap 68 has a base 69 which engages on bottle 67 in the conventional manner and has a tapered fluid dispensing spout 71 which extends outward from the base. A hook 72 extends laterally and preferably somewhat upwardly from the distal end 73 of spout 71 and a pointed pick 74 extends laterally from the opposite side of the end 73 of the spout. The hook 72 and pick 74 are sufficiently small to be insertable into the previously described tubes 12. Hook 72 may be used to draw hair into the tubes 12 essentially in the same manner that has been previously described with reference to FIG. 9 and pick 74 may be used to withdraw hair from the tubes. The cap 68 on bottle 67 enables introduction of hair treating solution into a tube 12 at the same time that a strand 13 of hair is being drawn into the tube.

While the invention has been described with respect to specific preferred embodiments, variations and modifications of the hair dressing system are possible and it is not intended to limit the invention except as defined in the following claims.

I claim:

1. Hairdressing apparatus for facilitating the application of a hair treating substance to selected strands of hair comprising at least one hollow tube having an interior region in which a selected strand of hair and said hair treating substance may be disposed, said tube having a fluid impervious sidewall with a slit that extends along the tube, said slit being defined by first and second longitudinally extending edge regions of said sidewall that abut each other when said tube is in an undistorted condition to inhibit the escape of said hair treating substance from said interior region, said tube being formed of flexible resilient material whereby said first and second edges may be temporarily pulled apart at a selected location along said slit to provide access to said interior region at that location, said material being transparent and wherein at least said first edge region of said tube sidewall has a visible stripe extending therealong to make the location of said slit readily apparent.

2. Hairdressing apparatus for facilitating the application of a hair treating substance to selected strands of hair comprising at least one hollow tube having an interior region in which a selected strand of hair and said hair treating substance may be disposed, said tube having a fluid impervious sidewall with a slit that extends along the tube, said slit being defined by first and second longitudinally extending edge regions of said sidewall that abut each other when said tube is in an undistorted condition to inhibit the escape of said hair treating substance from said interior region, said tube being formed of flexible resilient material whereby said first and second edges may be temporarily pulled apart at a selected location along said slit to provide access to said interior region at that location, wherein said slit extends along an external surface of said tube, and wherein said apparatus further includes a fluid impervious channel shaped cap member having an internal surface with a configuration conforming to said external surface of said tube, said cap member being formed of flexible resilient material and being proportioned for fitting onto said tube over said slit thereof.

3. The hairdressing apparatus of claim 2 wherein said material of which said cap member is formed is transparent.

4. The hair dressing apparatus of claim 3 wherein said said cap member has spaced apart opposite edges extending therealong and has a visible stripe which extends along the cap member at a location that is substantially equidistant from said opposite edges.

5. Hairdressing apparatus for facilitating the application of a hair treating substance to selected strands of hair comprising at least one hollow tube having an interior region in which a selected strand of hair and said hair treating substance may be disposed, said tube having a fluid impervious sidewall with a slit that extends along the tube, said slit being defined by first and second longitudinally extending edge regions of said sidewall that abut each other when said tube is in an undistorted condition to inhibit the escape of said hair treating substance from said interior region, said tube being formed of flexible resilient material whereby said first and second edges may be temporarily pulled apart at a selected location along said slit to provide access to said interior region at that location, further including a flat backing plate secured to said tube in parallel relationship therewith, said backing plate being secured to said tube along a zone thereon that extends in parallel relationship with said slit.

6. The hairdressing apparatus of claim 5 wherein said backing plate is in tangential relationship to said sidewall of said tube along a zone thereon that is opposite from said slit.

7. Hairdressing apparatus for facilitating the application of a hair treating substance to selected strands of hair comprising at least one hollow tube having an interior region in which a selected strand of hair and said hair treating substance may be disposed, said tube having a fluid impervious sidewall with a slit that extends along the tube, said slit being defined by first and second longitudinally extending edge regions of said sidewall that abut each other when said tube is in an undistorted condition to inhibit the escape of said hair treating substance from said interior region, said tube being formed of flexible resilient material whereby said first and second edges may be temporarily pulled apart at a selected location along said slit to provide access to said interior region at that location, further including a flat backing plate having a plurality of said tubes secured thereto, said tubes being in parallel relationship with said backing plate and in parallel relationship with each other and wherein said tubes are spaced apart a distance sufficient to enable flattening of selected portions of said tube against said backing plate.

8. Hairdressing apparatus for facilitating the application of a hair treating substance to selected strands of hair comprising at least one hollow tube having an interior region in which a selected strand of hair and said hair treating substance may be disposed, said tube having a fluid impervious sidewall with a slit that extends along the tube, said slit being defined by first and second longitudinally extending edge regions of said sidewall that abut each other when said tube is in an undistorted condition to inhibit the escape of said hair treating substance from said interior region, said tube being formed of flexible resilient material whereby said first and second edges may be temporarily pulled apart at a selected location along said slit to provide access to said interior region at that location, wherein said tube has first and second opposite ends further including clamping means for compressing at least one of said ends of said tube and for further compressing said tube at a selected location therealong that is between said opposite ends to isolate one portion of said interior region of said tube from an adjoining portion thereof.

9. Hairdressing apparatus for facilitating the application of a hair treating substance to selected strands of hair comprising at least one hollow tube having an interior region in which a selected strand of hair and said hair treating substance may be disposed, said tube having a fluid impervious sidewall with a slit that extends along the tube, said slit being defined by first and second longitudinally extending edge regions of said sidewall that abut each other when said tube is in an undistorted condition to inhibit the escape of said hair treating substance from said interior region, said tube being formed of flexible resilient material whereby said first and second edges may be temporarily pulled apart at a selected location along said slit to provide access to said interior region at that location, further including a hair manipulating tool having a handle with upper and lower ends, said tool further having first and second hooks at the lower end of the handle, said first hook having an upwardly directed pointed tip and said second hook having a downwardly directed pointed tip, said first and second hooks being opposite ends of an internal enlargement at said lower end of said handle and being jointly proportioned for insertion into said interior region of said tube through said slit.

10. Hairdressing apparatus for facilitating the application of a hair treating substance to selected strands of hair comprising at least one hollow tube having an interior region in which a selected strand of hair and said hair treating substance may be disposed, said tube having a fluid impervious sidewall with a slit that extends along the tube, said slit being defined by first and second longitudinally extending edge regions of said sidewall that abut each other when said tube is in an undistorted condition to inhibit the escape of said hair treating substance from said interior region, said tube being formed of flexible resilient material whereby said first and second edges may be temporarily pulled apart at a selected location along said slit to provide access to said interior region at that location, further including a cap for a hair treating solution bottle, said cap having a base adapted for engagement on said bottle and having a tubular solution dispensing tip extending outward from said base, said tip having a distal end proportioned for insertion into said interior region of said tube through said slit, further including a hook extending laterally from said tip at said distal end thereof and being proportioned for entry into said interior region of said tube through said slit along with said distal end of said tip and a pointed pick extending laterally from said tip at said distal end thereof in an opposite direction relative to said hook, said pick also being proportioned for entry into said interior region of said tube through said slit.

11. Hairdressing apparatus for facilitating the application of a hair treating substance to selected strands of hair comprising a flat backing plate, a plurality of tubes secured to said backing plate, said tube being parallel to said backing plate and being parallel to each other and being spaced apart a distance sufficient to enable flattening of selected ones of said tubes at selected locations therealong without interference from an adjacent tube, each of said tubes having a fluid impervious sidewall with a slit that extends along the tube which slit is spaced apart from said backing plate, said slit being defined by first and second overlapping edge regions of said sidewall that abut each other when said tube is in an undistorted condition, said tubes being formed of flexible resilient material enabling temporary opening of said slits at selected locations along the length of said tubes.

12. The hairdressing apparatus of claim 11 further including a plurality of clamps adapted to flattening said tubes against said backing plate at selected locations along the length thereof.

13. The hairdressing apparatus of claim 11 further including a plurality of fluid impervious substantially channel shaped cap members formed of flexible resilient material and being proportioned for engagement on said cylinders over said slits thereof.

14. Hairdressing apparatus for facilitating the application of a hair treating substance to selected strands of hair comprising at least one hollow tube having an interior region in which a selected strand of hair and said hair treating substance may be disposed, said tube having a fluid impervious sidewall with a slit that extends along the tube, said slit being defined by first and second longitudinally extending edge regions of said sidewall that abut each other when said tube is in an undistorted condition to inhibit the escape of said hair treating substance from said interior region, said tube being formed of flexible resilient material whereby said first and second edges may be temporarily pulled apart at a selected location along said slit to provide access to said interior region at that location, further including a hair manipulating tool having a handle with a grippable upper end, said tool having a narrow lower end being proportioned for insertion into the interior region of said tube through said slit and for opening said slit to permit the forcing of a plurality of strands of hair into said region.

15. Hairdressing apparatus for facilitating the application of a hair treating substance to selected strands of hair comprising at least one hollow tube having an interior region in which a selected strand of hair and said hair treating substance may be disposed, said tube having a fluid impervious sidewall with a slit that extends along the tube, said slit being defined by first and second longitudinally extending edge regions of said sidewall that abut each other when said tube is in an undistorted condition to inhibit the escape of said hair treating substance from said interior region, said tube being formed of flexible resilient material whereby said first and second edges may be temporarily pulled apart at a selected location along said slit to provide access to said interior region at that location, further including a cap for a hair treating solution bottle, said cap having a base adapted for engagement on said bottle and having a tubular solution dispensing tip extending outward from said base, said tip having a distal end proportioned for insertion into said interior region of said tube through said slit.

* * * * *